US011053738B1

(12) United States Patent
Blake

(10) Patent No.: US 11,053,738 B1
(45) Date of Patent: Jul. 6, 2021

(54) LADDER CADDY SYSTEM

(71) Applicant: James Francis Blake, Prescott Valley, AZ (US)

(72) Inventor: James Francis Blake, Prescott Valley, AZ (US)

( * ) Notice: Subject to any disclaimer, the term of this patent is extended or adjusted under 35 U.S.C. 154(b) by 0 days.

(21) Appl. No.: 17/088,738

(22) Filed: Nov. 4, 2020

(51) Int. Cl.
*E06C 7/14* (2006.01)

(52) U.S. Cl.
CPC ..... *E06C 7/14* (2013.01)

(58) Field of Classification Search
CPC ... E04G 5/003; E06C 1/39; E06C 7/14; E06C 7/16
USPC ..... 248/210, 206.5; 182/129
See application file for complete search history.

(56) References Cited

U.S. PATENT DOCUMENTS

| | | | | |
|---|---|---|---|---|
| 5,135,193 | A | 8/1992 | Parris | |
| 5,333,823 | A | 8/1994 | Joseph | |
| 5,573,081 | A | 11/1996 | Bartnicki et al. | |
| 5,624,093 | A | 4/1997 | Gemmell | |
| 5,727,649 | A | 3/1998 | Buckley | |
| 6,148,958 | A | 11/2000 | Ahl et al. | |
| 6,412,601 | B1 | 7/2002 | Schmidt | |
| 6,823,998 | B2 * | 11/2004 | Fabregas | B25H 3/06 206/373 |
| 7,032,711 | B1 | 4/2006 | Katz et al. | |
| 7,114,592 | B1 | 10/2006 | Gibson et al. | |
| 7,753,170 | B1 | 7/2010 | Gibson | |
| 7,967,264 | B1 | 6/2011 | Peterson | |
| 8,596,454 | B1 | 12/2013 | Carlson | |
| 8,919,713 | B2 | 12/2014 | Reusser | |
| 10,184,292 | B2 | 1/2019 | Latimer et al. | |
| 10,458,183 | B2 | 10/2019 | Tiber et al. | |
| 10,801,263 | B2 * | 10/2020 | Dangrow | E06C 1/18 |
| 2004/0217241 | A1 * | 11/2004 | Searcy | E06C 7/14 248/210 |
| 2007/0181367 | A1 * | 8/2007 | Astor | E06C 7/14 182/129 |
| 2009/0078504 | A1 * | 3/2009 | Astor | E06C 7/14 182/129 |
| 2009/0283361 | A1 | 11/2009 | Gibson et al. | |
| 2012/0175329 | A1 | 7/2012 | Johnson | |

(Continued)

*Primary Examiner* — Steven M Marsh
(74) *Attorney, Agent, or Firm* — Invention To Patent Services; Alex Hobson

(57) ABSTRACT

A ladder caddy system is detachable attachable to a ladder top via a ladder connector, having a magnet configured below the ladder top. In an exemplary embodiment, the ladder connector is aligned with the ladder aperture in the ladder top and the main connector is inserted through the ladder aperture and into the ladder connector to magnetically couple the main connector magnet with the ladder connector magnet. The main receptacle assembly includes a main receptacle and may have a power tool retainer attached thereto and configured to retain a power tool such as a power drill. A retainer band may further secure a power tool in the power tool retainer. Other receptacles may be detachable attachable to the main receptacle assembly, such as a ring receptacle that comprises a conduit, a ring that can be slid over the power tool retainer. A detachable receptacle may be coupled to the main receptacle via a detachable receptacle connector that has a magnet that is attracted to main receptacle connector or secondary connector of the main receptacle.

20 Claims, 14 Drawing Sheets

(56) References Cited

U.S. PATENT DOCUMENTS

2014/0358275 A1* 12/2014 Browne ..... F16M 13/022
700/214
2018/0094487 A1* 4/2018 Ellis ..... E06C 7/16

* cited by examiner

LADDER CADDY SYSTEM

BACKGROUND OF THE INVENTION

Field of the Invention

The invention relates to ladder caddy system having a main receptacle that is detachably attachable to a ladder top via a ladder connector that has a magnet configured below the ladder top and wherein a main receptacle connector, having a main connector magnet, extends into the ladder connector to magnetically couple the with the magnet of the ladder connector.

Background

Working on a ladder is dangerous and typically requires a number of tools, implements or fasteners to be in reach. Tool belts can be worn to retain tools, fasteners and the like but are not configured to retain power tools and bigger implements.

SUMMARY OF THE INVENTION

The invention is directed to a ladder caddy system that is detachable attachable to a top platform of a ladder, or ladder top, via a ladder connector, having a ladder connector magnet configured below the ladder top. In an exemplary embodiment, the ladder connector is aligned with the ladder aperture in the ladder top and the main connector is inserted through the ladder aperture and into the ladder connector to magnetically couple the main connector magnet with the ladder connector magnet. The main receptacle assembly includes a main receptacle and may have a power tool retainer attached thereto and configured to retain a power tool, such as a power drill. A retainer band may further secure a power tool in the power tool retainer. Other receptacles may be detachable attachable to the main receptacle assembly, such as a ring receptacle that comprises a conduit, a ring that can be slid over the power tool retainer. A detachable receptacle may be coupled to the main receptacle via a detachable receptacle connector that has a magnet that magnetically couples, or is attracted to, a magnet of the main receptacle connector or secondary connector of the main receptacle.

The ladder connector may be cylindrical in shape and have a cylindrically shaped ladder connector aperture to receive the main connector extension. The ladder connector magnet may be configured in the bottom of the ladder connector aperture. The main receptacle connector may have a main connector extension, with the main connector magnet on an extended end of the main connector extension. The main connector extension may be configured for insertion into the ladder connector aperture to configure the two magnets next to each other to magnetically couple the magnets together. Magnetically coupled means that a south pole of a magnet is facing a north pole of a magnet. The ladder connector may have a flange that rests on the ladder top and the ladder connector extension may extend down through the ladder aperture. In an alternative embodiment, the ladder connector flange or top or the ladder connect is configured on the underside of the ladder top and aligned with the aperture in the ladder top. A portion of the ladder connector may be inserted into the aperture in the ladder top to provide some stability and to help position the ladder connector aperture with the ladder top aperture.

A main receptacle assembly has a main receptacle formed by a main receptacle wall and base that may be used to retain tools, fasteners and implements therein. A main receptacle wall may have a cylindrical shaped with a flat base. In an exemplary embodiment, the main receptacle connector extends from the bottom of the base of the main receptacle and has a main connector extension with a main connector magnet configured on the extended end of the main connector extension. The magnet of the main receptacle connector magnetically couples with the magnet of the ladder connector to secure the main receptacle to the ladder top. A main receptacle connector may also have a secondary connector that extends from main receptacle wall, such as outward from the main receptacle wall. A secondary connector may have a connector extension that extends orthogonally from the main receptacle wall and have a magnet on an extended end of the secondary connector extension. A detachable receptacle may be coupled to the main receptacle via this secondary connector, as further described herein.

The main receptacle assembly may have a power tool retainer that comprises an aperture in the top and bottom of the retainer. The open bottom may enable a drill with a drill bit to extend through the bottom of the power tool retainer. A power tool retainer may be coupled with the main receptacle wall and be configured along the outside of the main receptacle, such as along an outside wall of the main receptacle wall. The power tool retainer wall may extend up above the top of the main receptacle wall. A retainer band may be coupled with the power tool retainer and be configured to extend over a power tool retained in the power tool retainer to secure it in place.

A ring receptacle assembly may be configured to detachably attach to the main receptacle assembly and may have a connector ring that is sized to fit over the power tool retainer wall. The power tool retainer wall may extend up beyond a top of the main receptacle wall and the connector ring may slide down over the power tool retainer wall and rest on the top of the main receptacle wall to detachably attach the ring receptacle assembly to the main receptacle. The connector ring may be cylindrical in shape and configured to fit around a cylindrically shaped top of a power tool retainer. A ring receptacle assembly may have a number of ring receptacles coupled to the connector ring. These ring receptacles may have a top opening and may have a bottom or may be open on the bottom to allow implement to extend therethrough, such as screwdrivers. A ring receptacle may be a cylinder that is coupled around the outside of the connector ring.

A detachable receptacle may be configured to detachably attach to the main receptacle assembly via a detachable receptacle connector that comprises a magnet. The magnet of the detachable receptacle may be configured in a bottom of a detachable receptacle aperture or at the end of a connector extension from the detachably receptacle. In an exemplary embodiment, a detachably receptacle connector has an extension that extends vertically and is configured with a magnet in the bottom of an aperture formed by said extension. This aperture may be configured to receive the main connector extension, having a magnet on the extended end of the main connector extension. The two magnets magnetically couple together to secure the detachable receptacle to the main receptacle. A detachable receptacle may have a plurality of detachable receptacle connectors, such as one that extend horizontally, or orthogonally from the detachable receptacle wall, or vertically along the detachable receptacle wall. The detachable receptacle connector that extends orthogonally from the detachable receptacle wall is configured for detachable attachment to the secondary connector of the main connector assembly. An extension of the detachable receptacle connector may extend out from or in from the detachable receptacle wall. When the extension is inward from the wall, the extension forms an aperture having a magnet therein for coupling with a secondary connector of the main connector. The detachable receptacle connector that extends vertically along the detachable receptacle wall is configured for detachable attachment to the main receptacle connector. A detachable connector may have a plurality of discrete receptacles that are coupled to the detachable receptacle, such as to the detachable receptacle wall.

The magnets used may be discs and may be configured within a cylinder or at the extended end of a cylinder that is part of a connector. The magnets may be N52 magnets and may have an effective magnetic force to retain the main receptacle assembly to the ladder connector, thereby effectively retaining the ladder caddy system to a ladder top. This same arrangement of complimentary magnets with a north pole, or side, facing a south pole, or side, may be used to connect the main receptacle assembly to the detachable receptacle and the magnetic force may be effective to retain the two components together without any additional support and with tool and implements retained therein.

The summary of the invention is provided as a general introduction to some of the embodiments of the invention and is not intended to be limiting. Additional example embodiments including variations and alternative configurations of the invention are provided herein.

BRIEF DESCRIPTION OF SEVERAL VIEWS OF THE DRAWINGS

The accompanying drawings are included to provide a further understanding of the invention and are incorporated in and constitute a part of this specification, illustrate embodiments of the invention, and together with the description serve to explain the principles of the invention.

Figure 1:
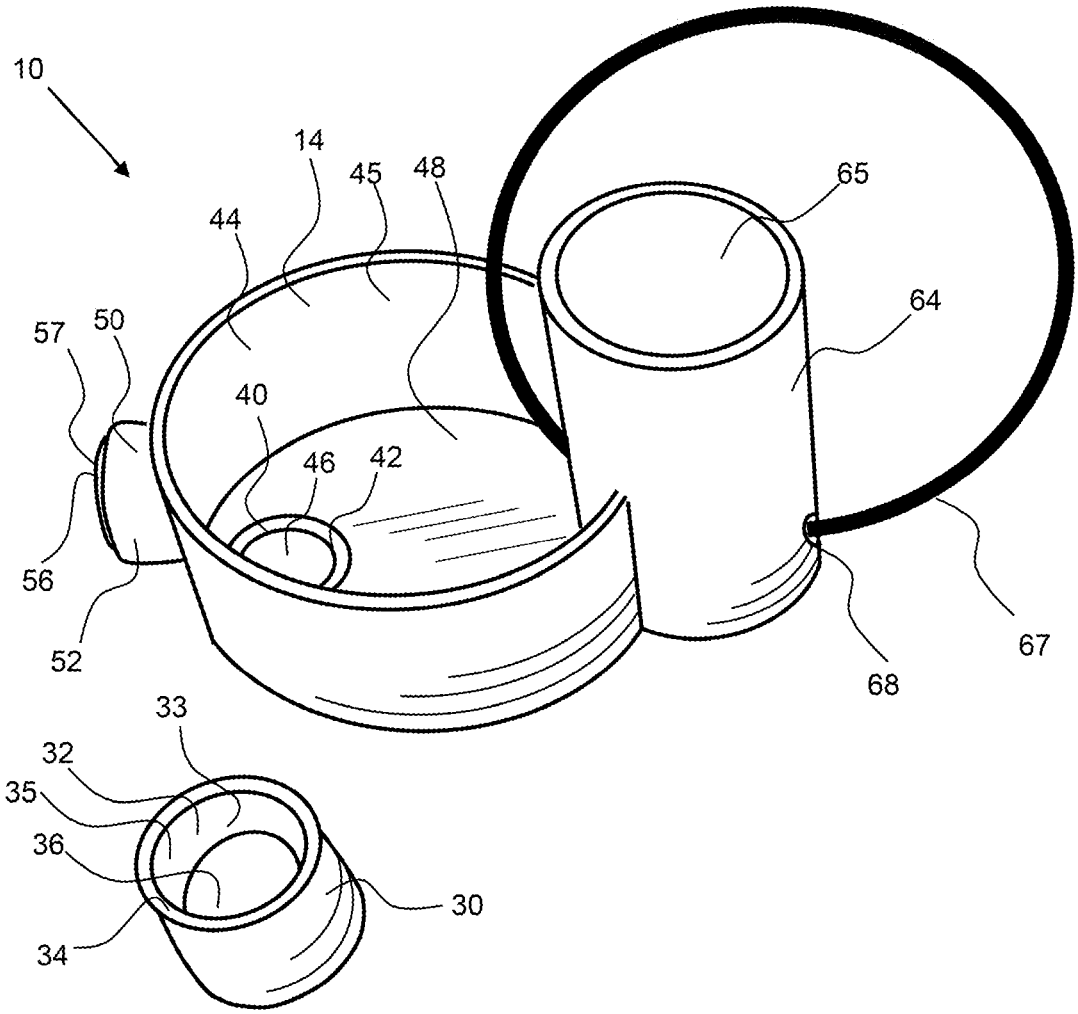
FIG. 1 shows a perspective view of a ladder caddy system having a ladder connector having a magnet in the base of the ladder connecter aperture and a main receptacle having a main receptacle connector configured to extend into the ladder connector and having a complimentary magnet on an extended end of the main connector extension.
Figure 2:
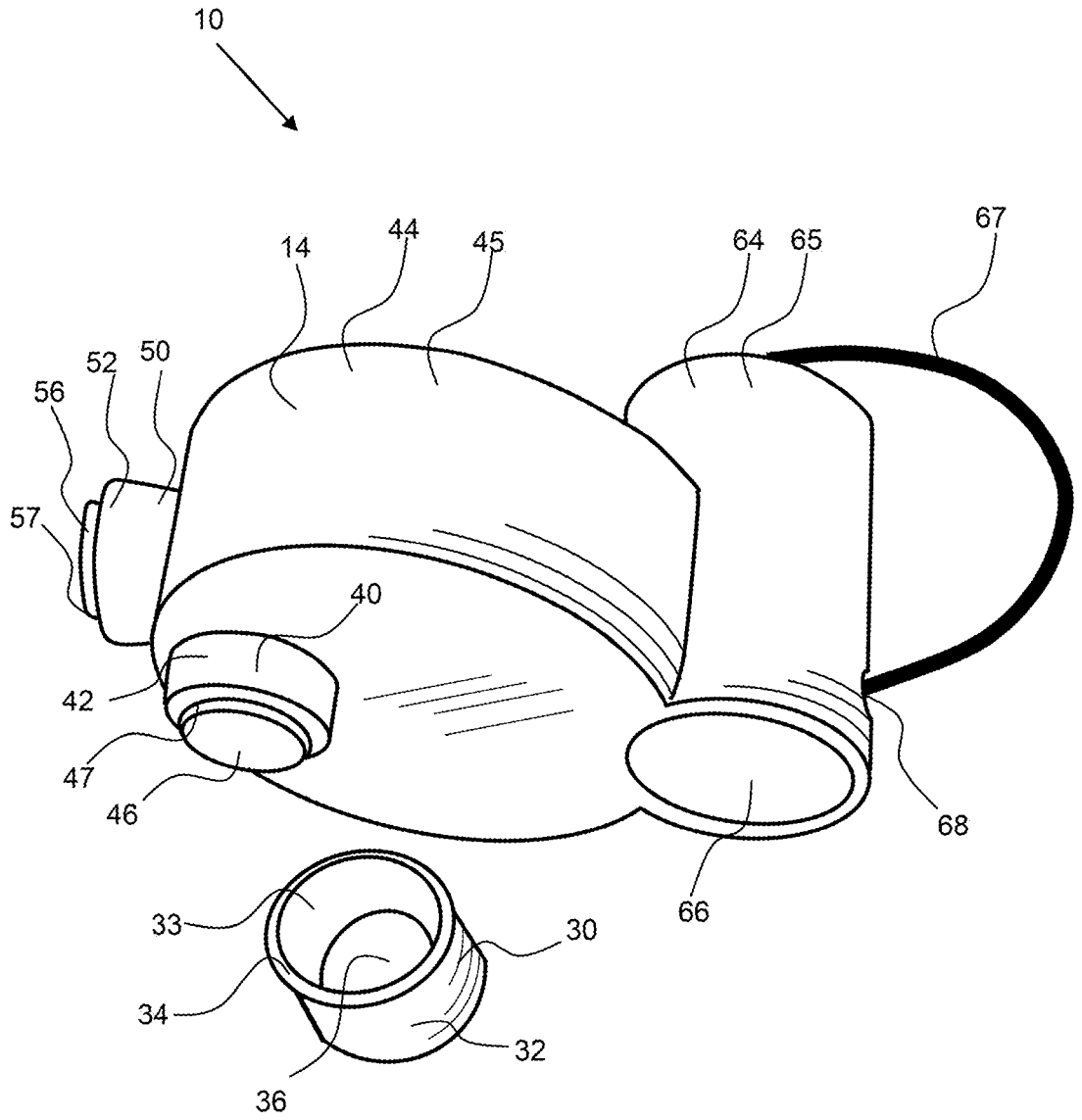
FIG. 2 shows a perspective view of a ladder caddy system having a ladder connector having a magnet in the base of the ladder connecter aperture and a main receptacle connector configured to extend into the ladder connector and having a complimentary magnet on an extended end of the main connector extension.

Corresponding reference characters indicate corresponding parts throughout the several views of the figures. The figures represent an illustration of some of the embodiments of the present invention and are not to be construed as limiting the scope of the invention in any manner. Further, the figures are not necessarily to scale, some features may be exaggerated to show details of particular components. Therefore, specific structural and functional details disclosed herein are not to be interpreted as limiting, but merely as a representative basis for teaching one skilled in the art to variously employ the present invention.

DETAILED DESCRIPTION OF THE ILLUSTRATED EMBODIMENTS

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Also, use of "a" or "an" are employed to describe elements and components described herein. This is done merely for convenience and to give a general sense of the scope of the invention. This description should be read to include one or at least one and the singular also includes the plural unless it is obvious that it is meant otherwise.

Certain exemplary embodiments of the present invention are described herein and are illustrated in the accompanying figures. The embodiments described are only for purposes of illustrating the present invention and should not be interpreted as limiting the scope of the invention. Other embodiments of the invention, and certain modifications, combinations and improvements of the described embodiments, will occur to those skilled in the art and all such alternate embodiments, combinations, modifications, improvements are within the scope of the present invention.

Figure 3:
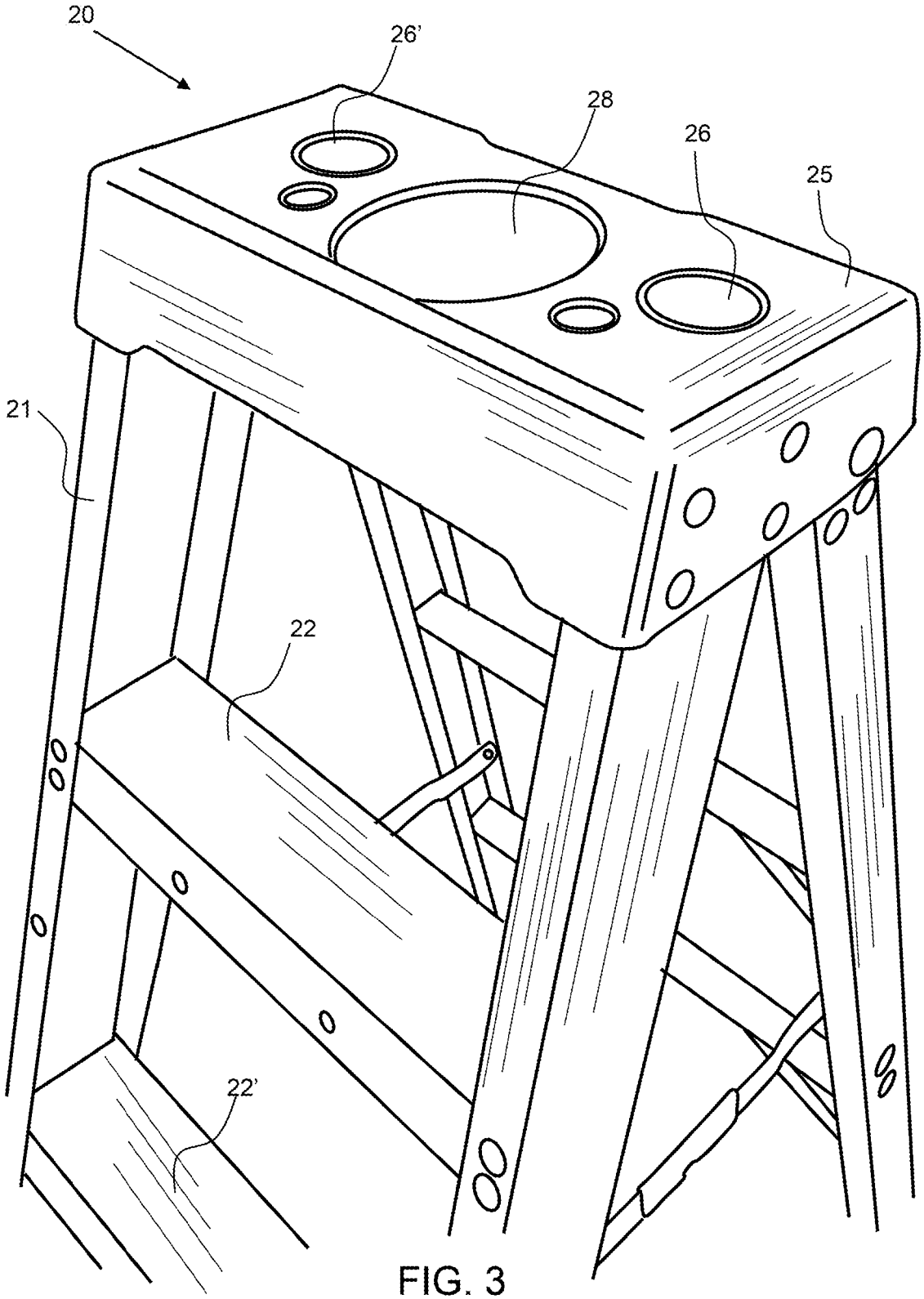
FIG. 3 shows a perspective view of a conventional step ladder having a ladder top with top apertures for detachably attaching the ladder caddy system.
Figure 4:
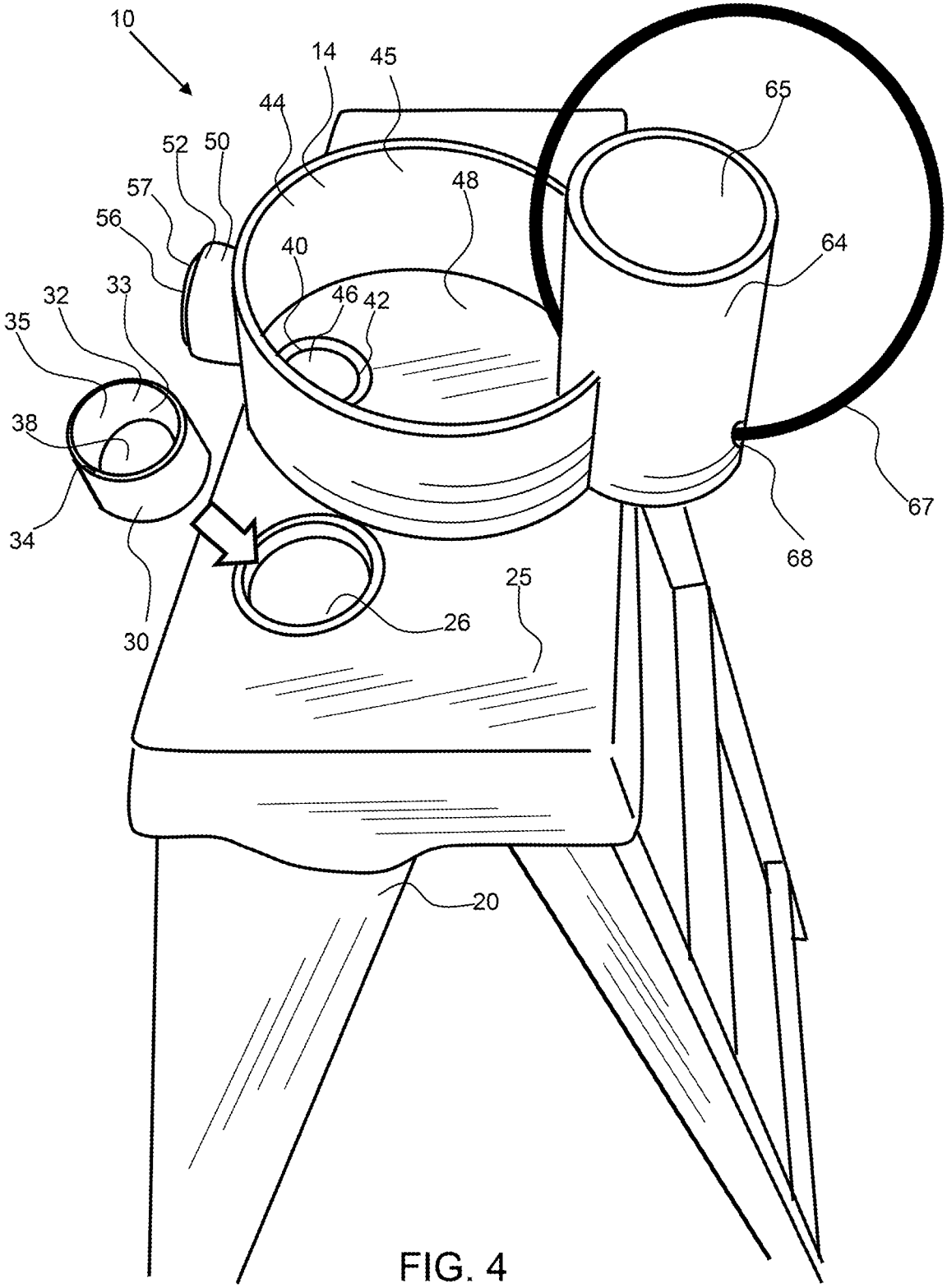
FIG. 4 shows a perspective view of an exemplary ladder caddy system configured for detachable attachment to the ladder top with the ladder connector extending down under the ladder top for receiving the main receptacle extension of the main receptacle connector.
Figure 5:
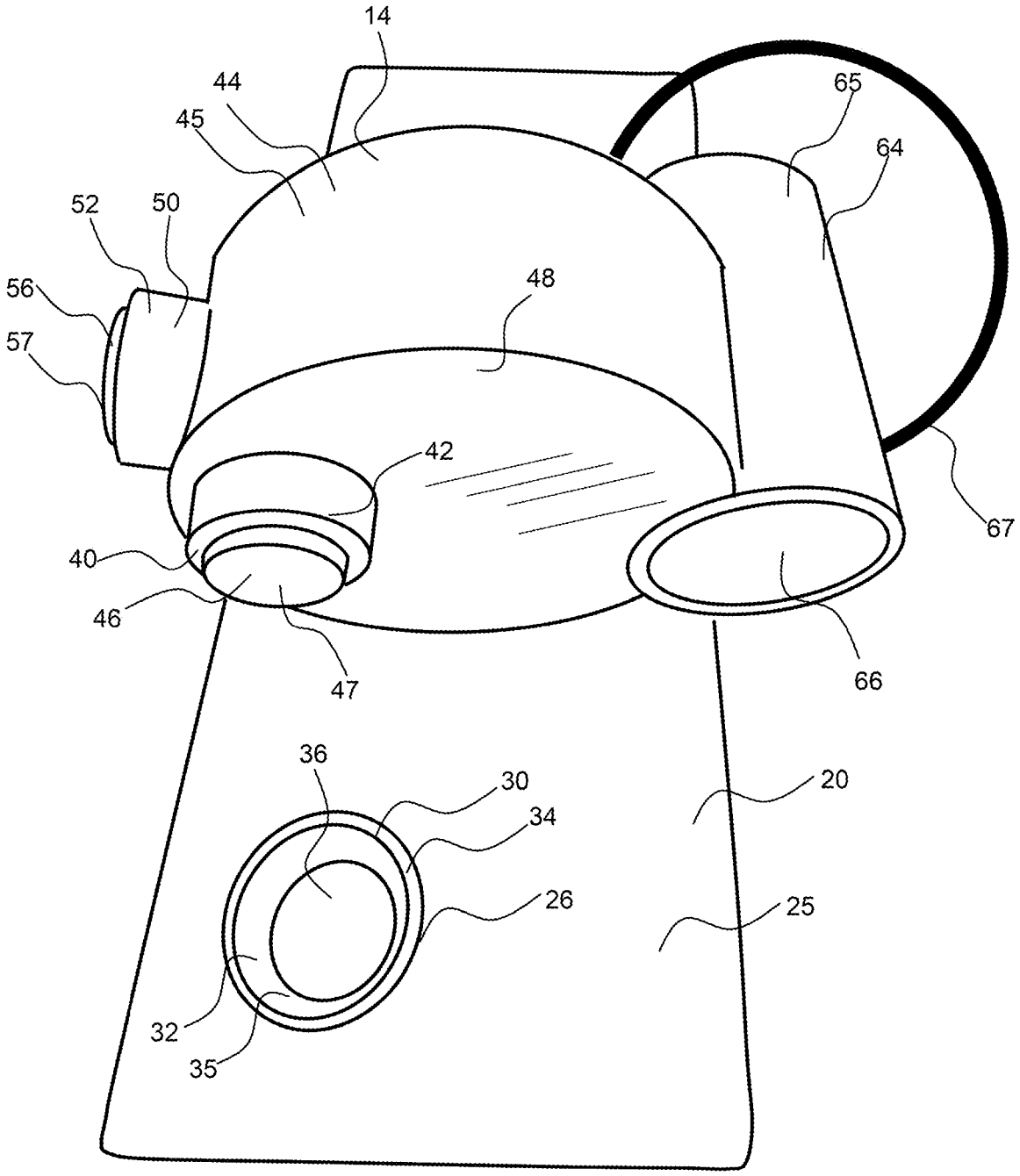
FIG. 5 shows a perspective view of an exemplary ladder caddy system configured for detachable attachment to the ladder top by insertion of the main receptacle connector of the main receptacle into the ladder connector; the ladder connector is configured in the top aperture of the ladder top and extends down from the underside of the ladder top.
Figure 6:
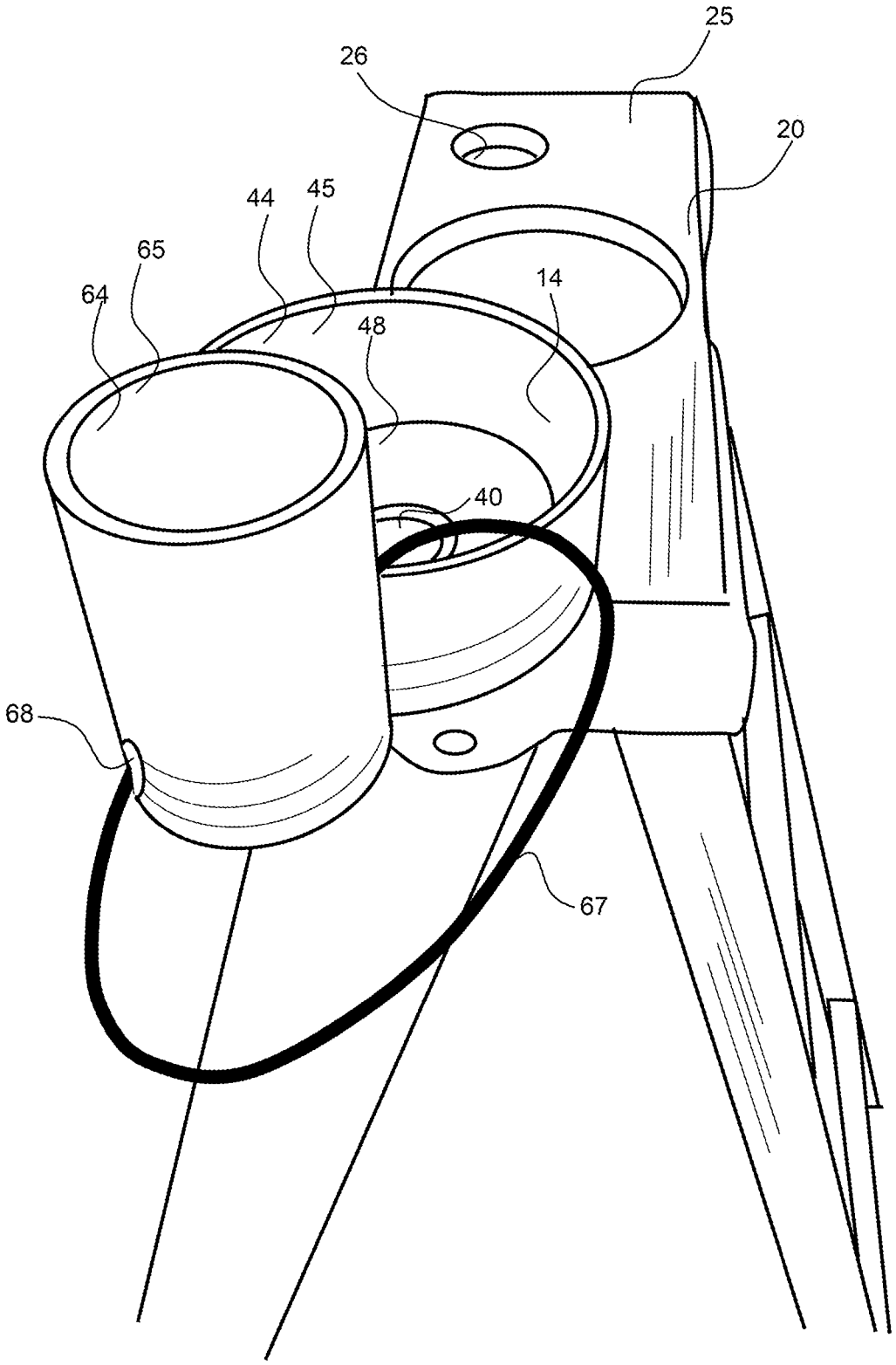
FIG. 6 shows a perspective view of an exemplary ladder caddy system detachable attached the ladder top with the ladder main receptacle connector coupled with the ladder connector.

Referring now to FIGS. 1 to 8, an exemplary ladder caddy system 10 has a ladder connector 30 having a ladder connector magnet 36 in the base of the ladder connector aperture 33. As shown in FIG. 3, a ladder 20 has a ladder top 25, with a plurality of apertures 26, 26', a recess 28, legs 21 and steps 22, 22'. The ladder connector has a ladder connector wall 35 forming a ladder connector extension 32 that is configured to extend down from a top aperture 26 in a ladder top 25. The ladder connector may have a flange 34 around the top of the ladder connector aperture that is configured to rest along the bottom or top of the ladder top aperture 26. As described herein, the flange may also rest on the underside of the ladder top around the ladder aperture. Also, a portion of the ladder connector may extend up into the ladder top aperture 26. A main receptacle 44 has a main receptacle connector 40 configured to extend into the ladder connector aperture and the main receptacle connector 40 has a complimentary main connector magnet 46 on an extended end 47 of the main connector extension 42. As best shown in FIG. 4, the ladder connector 30 has a ladder connector extension 32 and a ladder connector wall 35 forming a ladder connector aperture 33 for insertion of the main receptacle connector. The ladder connector also has a flange 34 around the top of the ladder connector wall 35 to retain the ladder connector to the ladder top 25, such as when inserted into the top aperture 26 of the ladder 20, as shown in FIG. 5, or when configured along the bottom of the ladder top. Also shown in FIG. 5, is the main receptacle connector 40 extending from the main receptacle base 48 and having a main connector extension 42 extending to a main connector magnet 46 on the extended end 47 of the main connector extension. The main connector magnet 46 of the main receptacle connector 40 is attracted to the ladder connector magnet 36 in the bottom of the ladder connector 30 to magnetically couple with the ladder connector magnet to securely retain the main receptacle assembly 14 to the ladder 20 in the top aperture 26 of the ladder.

Figure 7:
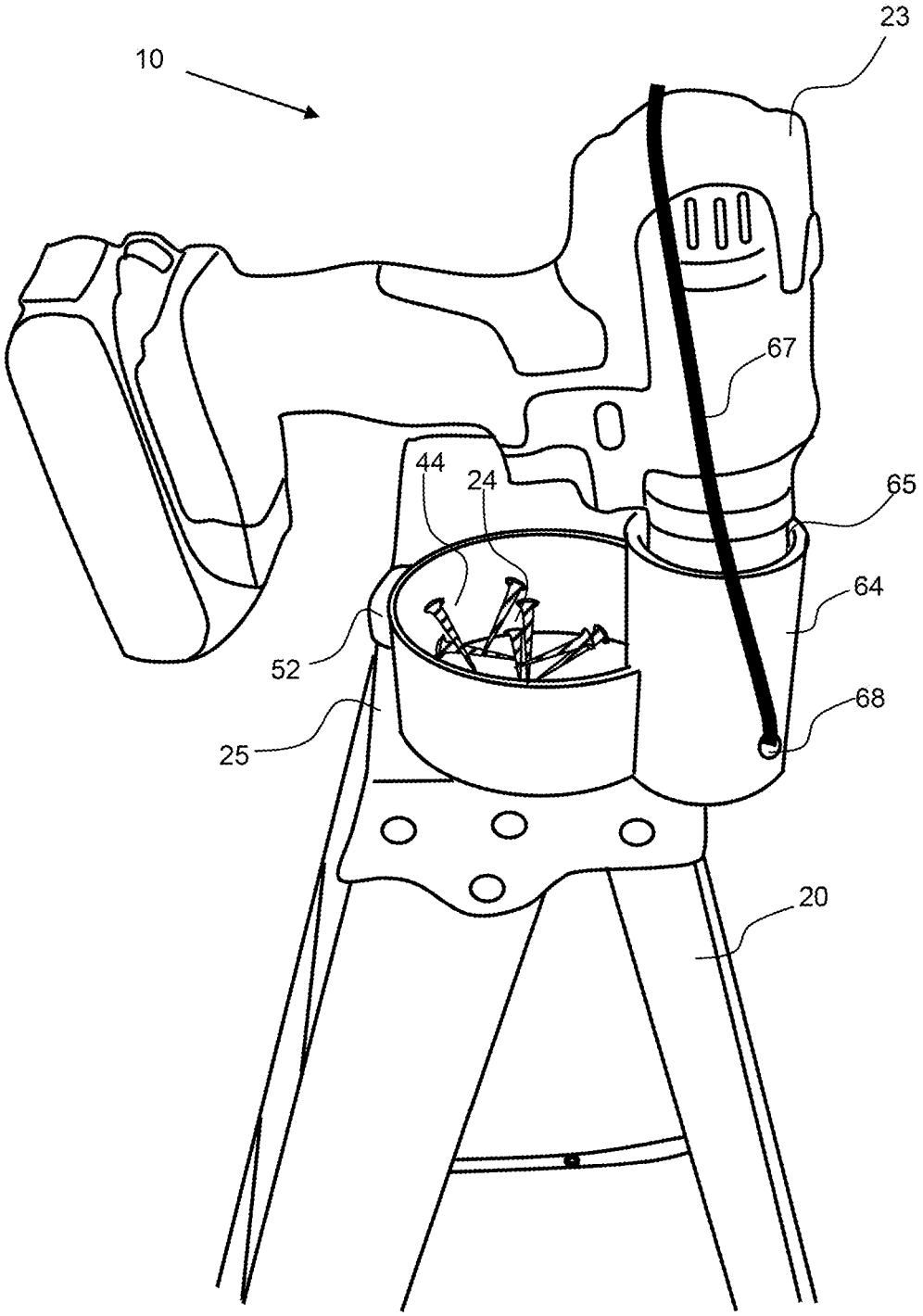
FIG. 7 shows a perspective view of an exemplary ladder caddy system detachable attached the ladder top with a drill retained in the power tool retainer and screws in the main receptacle.

The main receptacle assembly 14 includes a main receptacle 44 having main receptacle wall 45 and main receptacle base 48 for retaining tools 24, such as screws therein. The main receptacle also has a power tool retainer 64 configured to retain a power tool therein, such as a drill, as shown in the FIGS. 7 and 8. The power tool retainer has a power tool retainer wall 65, such as a cylindrical wall, and a retainer band 67 that extends into retainer band apertures 68 of said wall. The retainer band may be a continuous band. The bottom of the power tool retainer may be open and have an aperture 66 therein to allow the power tool or drill bit extending therefrom to extend down and out of the power tool retainer. As shown in FIG. 7, a power tool 23, a drill, is retained in the power tool retainer 64 by insertion therein with the retainer band 67 extending around the drill.

Figure 8:
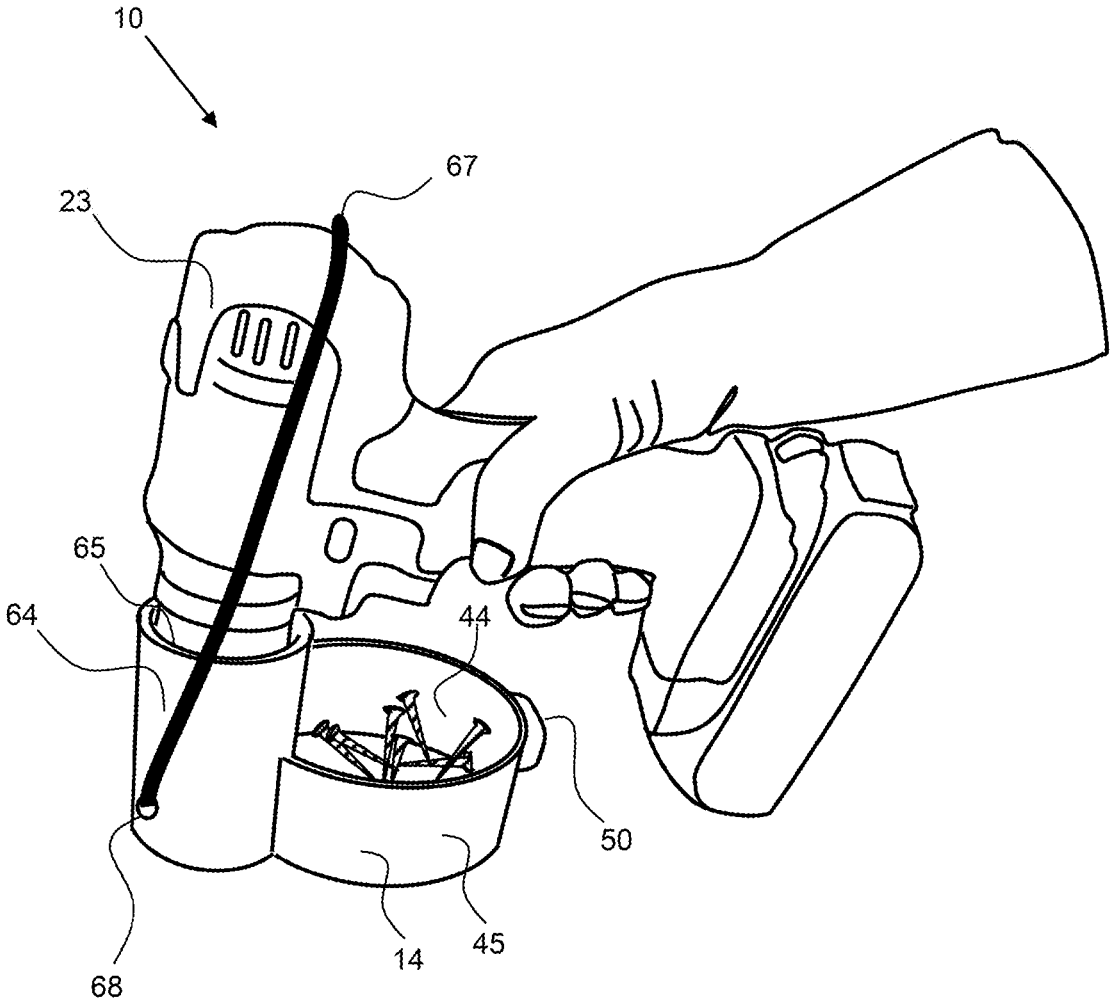
FIG. 8 shows a perspective view of an exemplary ladder caddy system detached from the ladder top and having a drill retained in the power tool retainer by a retainer band.

As shown in FIG. 8, the main receptacle assembly 14 is detached from the ladder and can be carried while attached to the power tool 23, a drill, with the retainer band 67 configured around the drill.

Referring to FIGS. 1, 2, 4 and 5, main receptacle assembly 14 may also include a secondary connector 50 that extends from the main receptacle wall 45 and has a secondary connector magnet 56 on an extended end 57 of the secondary connector extension 52.

Figure 9:
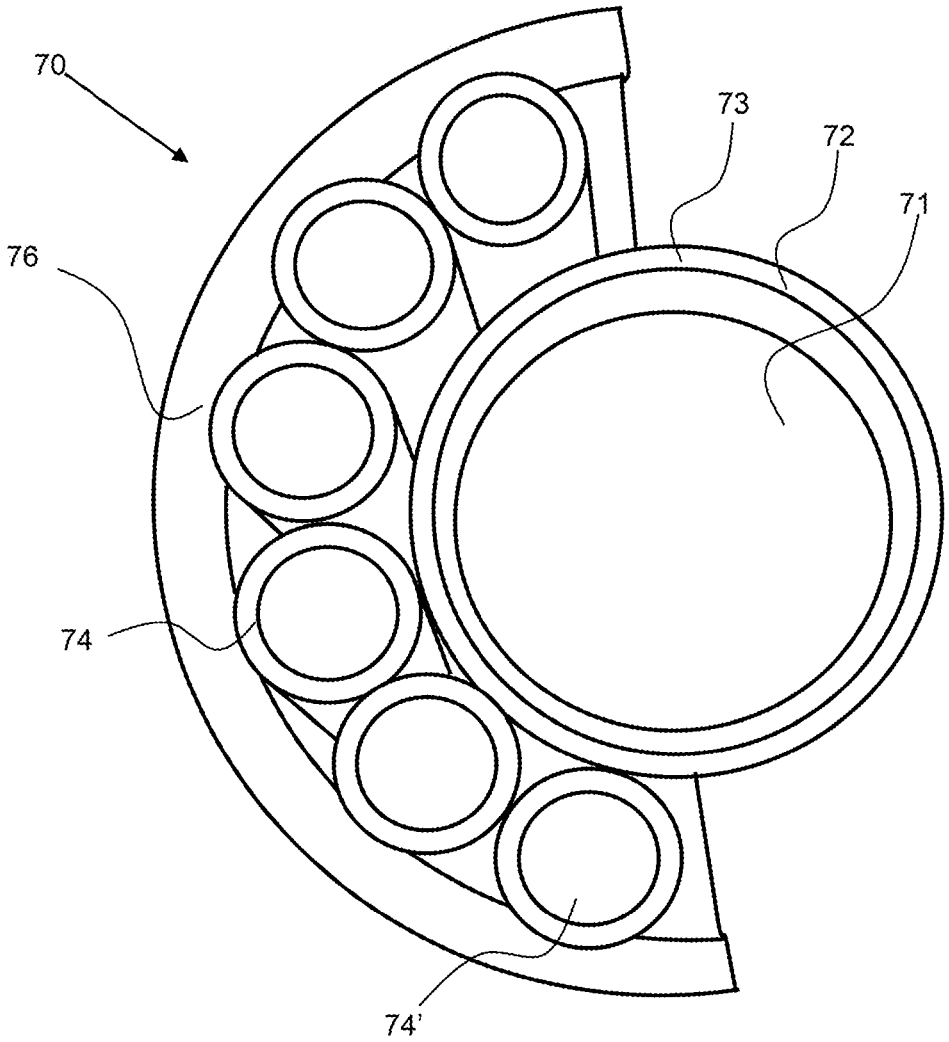
FIG. 9 shows a top view of an exemplary ring receptacle assembly having connector ring configured to slide down over the power tool retainer of the main receptacle assembly and a plurality of ring receptacles configured around the connector ring.
Figure 10:
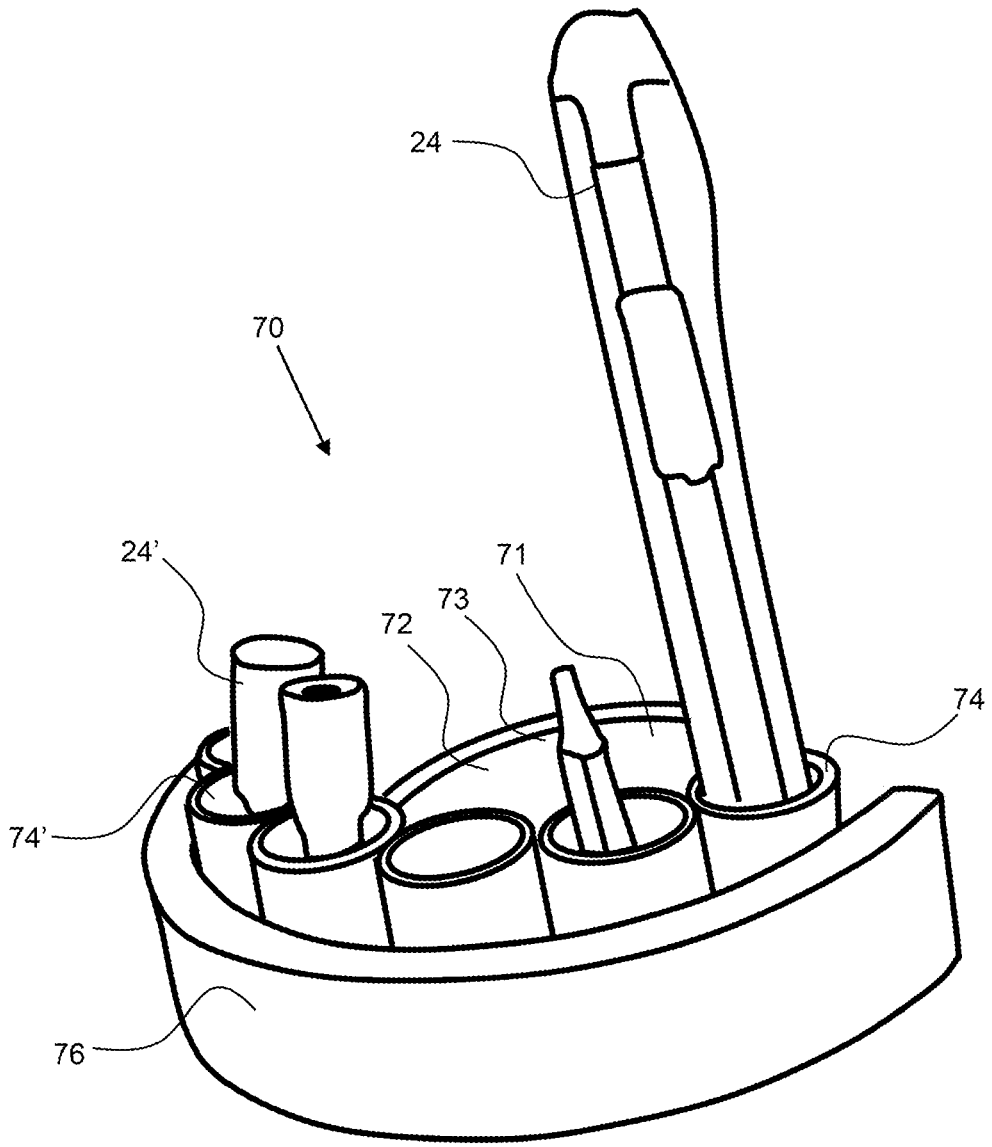
FIG. 10 shows a perspective view of an exemplary ring receptacle assembly having a connector ring configured to slide down over the power tool retainer of the main receptacle assembly and a plurality of ring receptacles configured around the connector ring.
Figure 11:
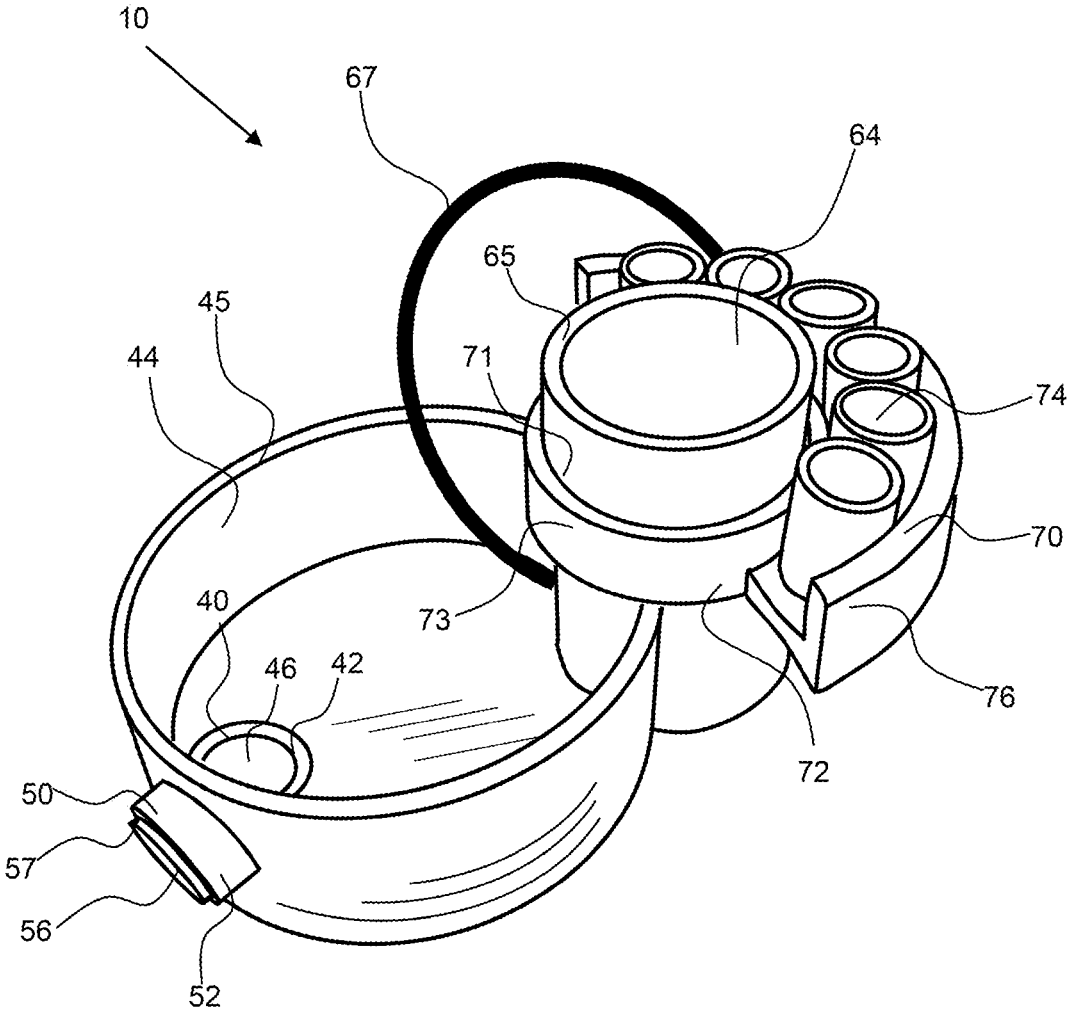
FIG. 11 shows a perspective view of an exemplary ladder caddy system having a main receptacle, a power tool retainer and a ring receptacle assembly configured around the power tool retainer.

Referring now to FIGS. 9 to 11, an exemplary ladder caddy system 10 may include a ring receptacle assembly 70 having a connector ring 72 configured to slide down over the power tool retainer wall 65 of the power tool retainer 64 of the main receptacle assembly 14. The ring receptacle has a connector ring 72 having a connector ring wall 73, forming a ring aperture 71 configured to fit around the cylindrical power tool retainer wall 65. The ring receptacle assembly 70 also has a plurality of ring receptacles 74, 74' coupled to the connector ring by a ring receptacle coupler 76. A variety of tools 24, 24' and implements may be retained in the ring receptacles as shown in FIG. 10. FIG. 10 shows a perspective view of an exemplary ring receptacle assembly 70 having a connector ring 72 configured to slide down over the power tool retainer of the main receptacle and a plurality of ring receptacles configured around the connector ring.

Figure 12:
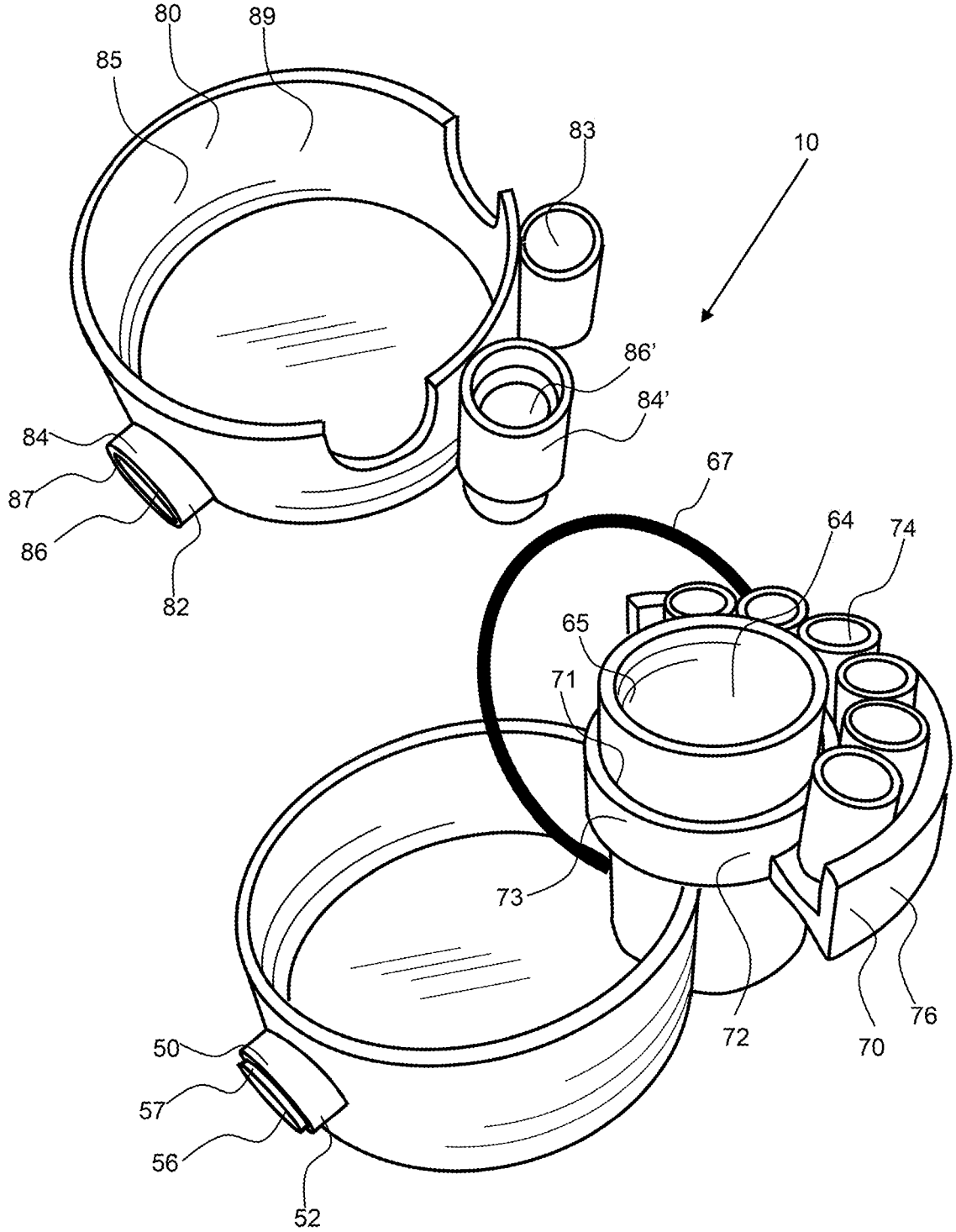
FIG. 12 shows a perspective view of an exemplary ladder caddy system having a main receptacle, a power tool retainer, a ring receptacle assembly configured around the power tool retainer and a detachable receptacle configured to detachably attach to the secondary connector of the main receptacle assembly by the detachable receptacle connector.
Figure 13:
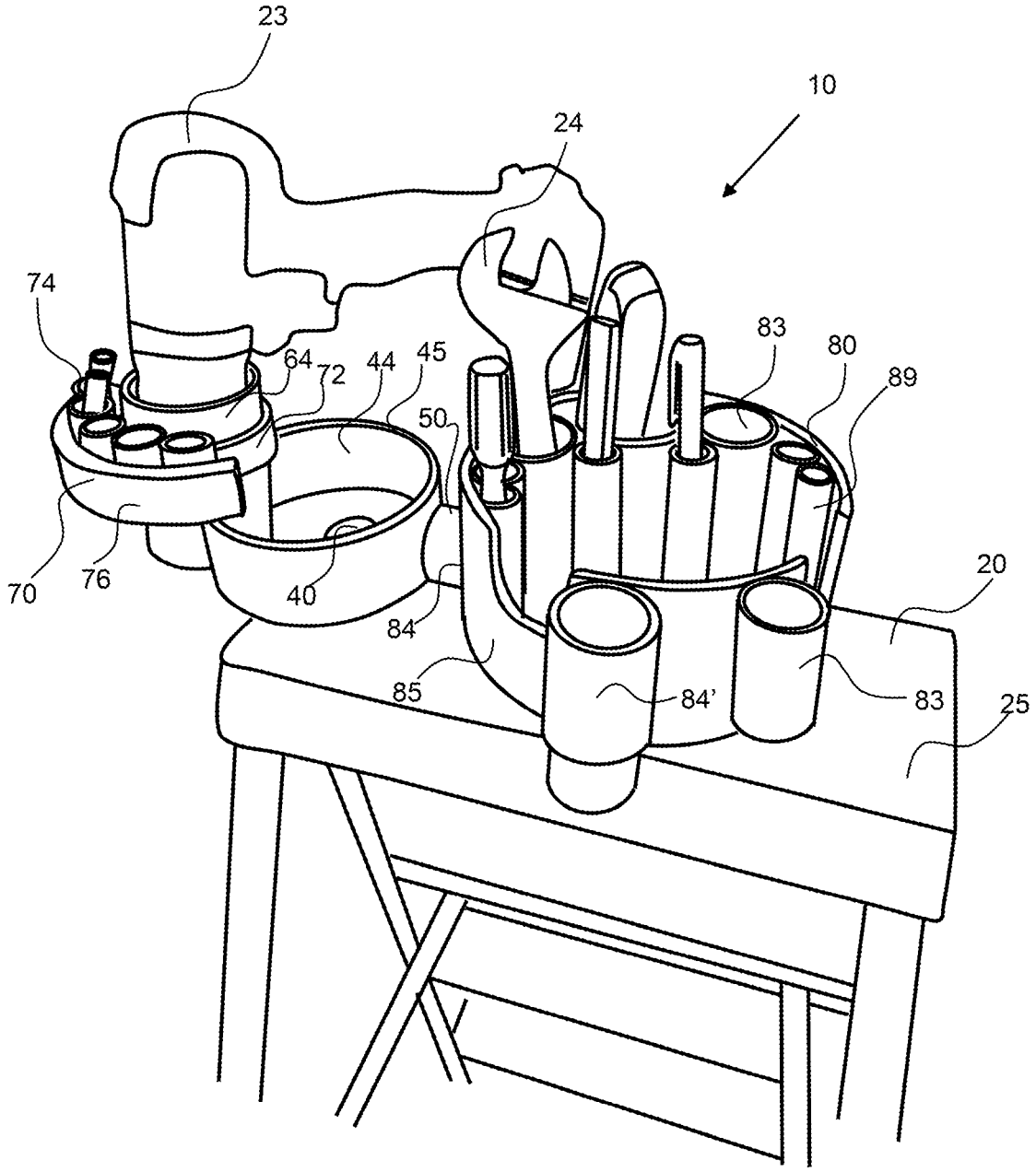
FIG. 13 shows a perspective view of an exemplary ladder caddy system coupled to a ladder top and having a main receptacle, a power tool retainer, a ring receptacle assembly configured around the power tool retainer and a detachable receptacle attached to the secondary connector of the main receptacle assembly by the detachable receptacle connector.

Referring to FIGS. 11 to 13, an exemplary ladder caddy system 10 has a main receptacle assembly 14, a power tool retainer 64 and a ring receptacle assembly 70 configured around the power tool retainer. The main receptacle assembly has a secondary connector 50 for detachably attaching a detachable receptacle assembly 89 by a detachable receptacle connector 84 extending from the detachable receptacle wall 85 that has a magnet 86 configured within the detachable receptacle connector extension 82. The connected assembly of the main receptacle assembly 14 and the detachable receptacle assembly is shown in FIG. 13. The detachable receptacle connector extension extends from the detachable receptacle wall 85 to a detachable receptacle connector extend end 87 and forms a conduit or aperture for receiving the detachable receptacle connector extension 82 of the secondary connector 50 to form a stable connection. A second detachable receptacle connector 84' extends vertically along the detachable receptacle wall 85, as shown in FIG. 12. The detachable receptacle assembly 89 has a detachable receptacle 80 formed by a detachable receptacle wall 85 and base 88 for retaining tools and implements and may also have additional detachable coupled receptacles 83. The detachable receptacle wall may be cylindrical in shape as shown.

As shown in FIG. 13, an exemplary ladder caddy system 10 is coupled to a ladder top 25 and has a main receptacle assembly 14, a power tool retainer 64, a ring receptacle assembly 70 configured around the power tool retainer and a detachable receptacle assembly 89 attached to the secondary connector 50 of the main receptacle assembly by the detachable receptacle connector 81.

Figure 14:
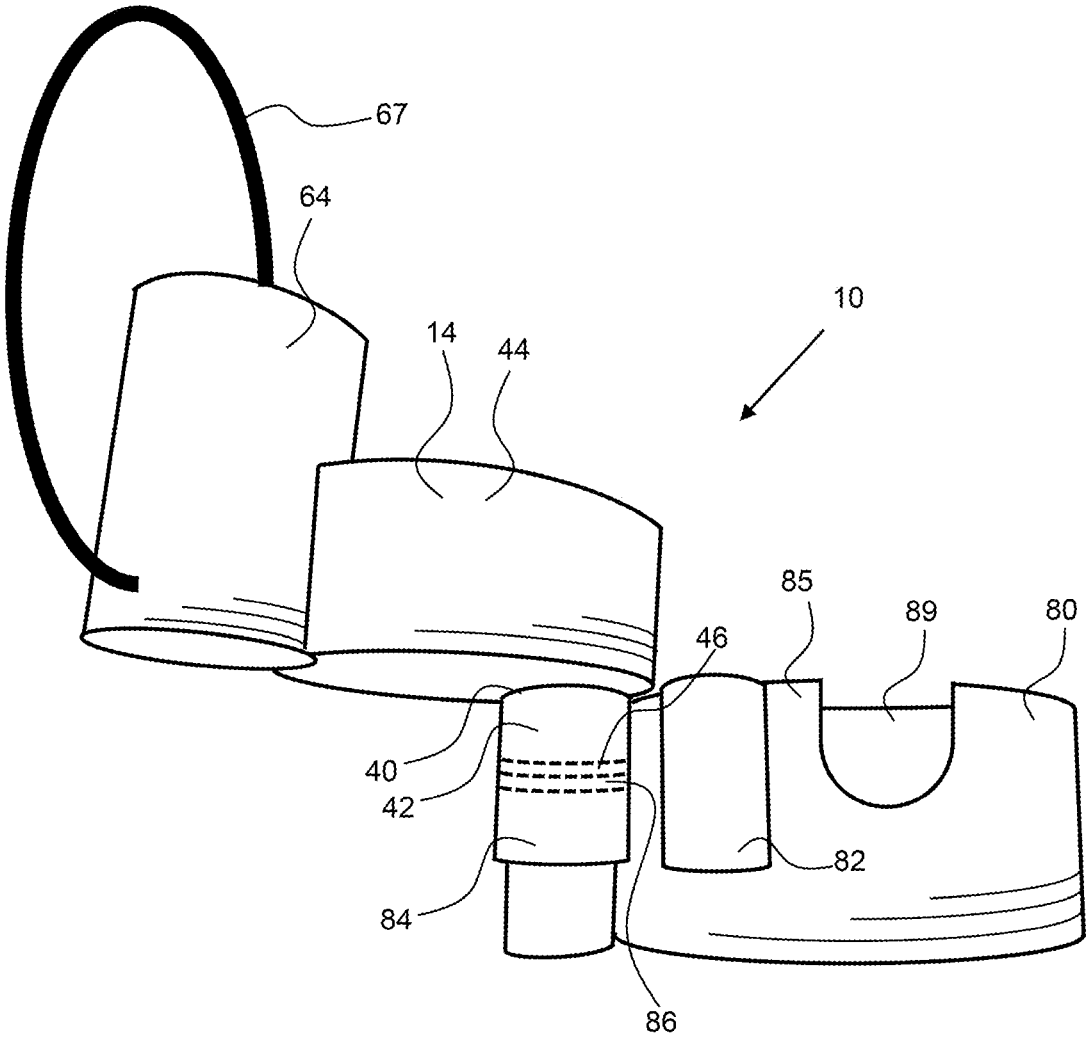
FIG. 14 shows a perspective view of an exemplary ladder caddy system having a main receptacle coupled to the detachable receptacle via the main receptacle connector extending into the detachable receptacle connector.

As shown in FIG. 14, an exemplary ladder caddy system 10 has a main receptacle assembly 14 coupled to a detachable receptacle assembly 89 with the main receptacle connector 40 of the main receptacle assembly inserted into the detachable receptacle connector 84. The detachable receptacle connector extends vertically along the wall of the detachable receptacle and has an aperture to receive the main connector extension, extending from the base of the main receptacle. The main connector extension 42 is inserted into the detachable receptacle connector as indicated by the dashed lines. The main connector magnet 46 is magnetically coupled with the detachable receptacle magnet 86, all indicated by the dashed lines. The magnetically attached magnets retain the detachable receptacle 80 to the main receptacle 40 such that they can be carried together without any additional support.

It will be apparent to those skilled in the art that various modifications, combinations and variations can be made in the present invention without departing from the scope of the invention. Specific embodiments, features and elements described herein may be modified, and/or combined in any suitable manner. Thus, it is intended that the present invention cover the modifications, combinations and variations of this invention provided they come within the scope of the appended claims and their equivalents.

What is claimed is:

1. A ladder caddy system comprising:

a) a ladder connector comprising;

i) a flange;

ii) a ladder connector magnet;

iii) a ladder connector extension extending from the flange to the ladder connector magnet iv) a ladder connector aperture in the connector extension extending from the flange to the ladder connector magnet;

wherein the ladder connector is configured to extend downward from a top aperture in a ladder top;

b) a main receptacle assembly comprising;

i) a main receptacle wall forming a main receptacle;

ii) a main receptacle base;

iii) a main receptacle connector extending from the main receptacle base and comprising:

a main connector extension extending from the main receptacle to a main connector extended end;

a main connector magnet configured on the main connector extended end;

wherein the main connector extension is configured for insertion into the ladder connector aperture wherein the ladder connector magnet magnetically couples to the main connector magnet to retain the ladder caddy assembly to said top of the ladder.

2. The ladder caddy system of claim 1, further comprising:

c) power tool retainer coupled to the main receptacle and comprising;

i) a power tool retainer wall; and ii) a retainer band coupled to the power tool retainer.

3. The ladder caddy system of claim 2, wherein the power tool retainer wall extends above the main receptacle wall.

4. The ladder caddy system of claim 3, wherein the power tool retainer wall is cylindrical in shape.

5. The ladder caddy system of claim 3, further comprising a ring receptacle assembly comprising;

a) a connector ring having a ring aperture configured to slide down over the power tool retainer wall to detachably attach the ring receptacle assembly to the power tool retainer; and b) a plurality of ring receptacles coupled to the connector ring.

6. The ladder caddy system of claim 5, wherein the plurality of ring receptacles are cylindrical in shape.

7. The ladder caddy system of claim 6, wherein the plurality of ring receptacles have an closed bottom.

8. The ladder caddy system of claim 1, further comprising a detachable receptacle comprising:

a) a detachable receptacle wall;

b) a detachable receptacle connector coupled to the detachable receptacle wall and comprising a detachable receptacle magnet; and wherein the main receptacle further comprises:

v) a secondary connector coupled to the main receptacle wall and comprising a secondary connector magnet; and wherein the detachable receptacle magnet is configured to magnetically couple with the secondary connector magnet to detachably attach the detachable receptacle to the main receptacle.

9. The ladder caddy system of claim 8, wherein the secondary connector comprises:

a secondary connector extension extending from the main receptacle wall to a secondary connector extended end;

wherein the secondary connector magnet is configured on the secondary connector extended end.

10. The ladder caddy system of claim 9, wherein the detachable receptacle connector extends horizontally from the detachable receptacle wall.

11. The ladder caddy system of claim 10, wherein the detachable receptacle connector comprises a detachable receptacle extension that extends to an extended end and wherein the detachable receptacle magnet is configured within the detachable receptacle extension; and wherein the secondary connector is configured for insertion into the detachable receptacle extension to magnetically couple the secondary connector magnet to the detachable receptacle magnet.

12. The ladder caddy system of claim 8, wherein the detachable receptacle connector extends vertically along the detachable receptacle wall.

13. The ladder caddy system of claim 1, further comprising a detachable receptacle comprising:

a) a detachable receptacle wall;

b) a detachable receptacle connector coupled to the detachable receptacle wall and comprising a detachable receptacle magnet; and wherein the main receptacle connector is configured to detachably attach to said detachably receptacle connector.

14. The ladder caddy system of claim 13, wherein the detachable receptacle connector extends vertically.

15. The ladder caddy system of claim 13, wherein the detachable receptacle connector extends along an outside of the detachable receptacle wall.

16. The ladder caddy system of claim 14, wherein the detachable receptacle connector comprises a detachable receptacle extension that extends to an extended end and wherein the detachable receptacle magnet is configured within the detachable receptacle extension; and wherein the main receptacle connector is configured for insertion into the detachable receptacle extension to magnetically couple the main connector magnet to the detachable receptacle magnet.

17. The ladder caddy system of claim 8, wherein the detachable receptacle comprises a plurality of discrete receptacle.

18. The ladder caddy system of claim 1, further comprising a detachable receptacle comprising:

a) a detachable receptacle wall;

b) a detachable receptacle connector coupled to the detachable receptacle wall and comprising a detachable receptacle magnet;

wherein the detachable receptacle connector extends horizontally from the detachable receptacle wall; and wherein the main receptacle further comprises:

vi) a secondary connector coupled to the main receptacle wall and comprising a secondary connector magnet; and wherein the detachable receptacle magnet is configured to magnetically couple with the secondary connector magnet to detachably attach the detachable receptacle to the main receptacle.

19. The ladder caddy system of claim 18, wherein the detachable receptacle connector comprises a second detachable receptacle extension that extends to an extended end and wherein a second detachable receptacle magnet is configured within the detachable receptacle extension; and wherein the main receptacle connector is configured for insertion into the detachable receptacle extension to magnetically couple the main connector magnet to the detachable receptacle magnet.

20. The ladder caddy system of claim 19, wherein the detachable receptacle comprises a plurality of discrete receptacle.

* * * * *